United States Patent [19]

Hlousek et al.

[11] Patent Number: 5,015,160

[45] Date of Patent: May 14, 1991

[54] INJECTION PUMP FOR INTERNAL COMBUSTION ENGINES

[75] Inventors: Jaroslaw Hlousek, Golling; Gerhard Lehner; Theodor Stipek, both of Hallein, all of Austria

[73] Assignee: Robert Bosch GmbH, Stuttgart, Fed. Rep. of Germany

[21] Appl. No.: 333,220

[22] Filed: Apr. 5, 1989

[30] Foreign Application Priority Data

Jun. 18, 1988 [DE] Fed. Rep. of Germany ..... 3820707

[51] Int. Cl.[5] ..... F02M 59/44

[52] U.S. Cl. ..... 417/499; 417/490; 123/447; 123/467

[58] Field of Search ..... 417/490, 493, 499; 123/447, 467, 506

[56] References Cited

U.S. PATENT DOCUMENTS

| | | | |
|---|---|---|---|
| 2,131,779 | 10/1938 | Zwick et al. | 417/494 |
| 2,157,737 | 5/1939 | Janssen | 417/252 |
| 2,298,936 | 10/1942 | Gambrell | 417/494 |
| 3,759,239 | 9/1973 | Regneault et al. | 123/447 X |
| 3,990,413 | 11/1976 | Pischinger | 417/499 X |
| 4,118,156 | 10/1978 | Ivosevic | 417/494 |
| 4,355,961 | 10/1982 | Riggs | 417/499 X |
| 4,513,719 | 4/1985 | Edo | 123/447 |
| 4,633,836 | 1/1987 | Faupel | 123/467 |
| 4,690,624 | 9/1987 | Schwartz | 417/499 |

FOREIGN PATENT DOCUMENTS

| | | | |
|---|---|---|---|
| 673809 | 3/1939 | Fed. Rep. of Germany . | |
| 762581 | 9/1951 | Fed. Rep. of Germany . | |
| 843763 | 5/1952 | Fed. Rep. of Germany . | |
| 2076971 | 10/1971 | France . | |
| 594134 | 12/1977 | Switzerland . | |
| 695080 | 8/1953 | United Kingdom | 417/493 |
| 1281308 | 7/1972 | United Kingdom . | |

*Primary Examiner*—John Rivell

*Attorney, Agent, or Firm*—Edwin E. Greigg; Ronald E. Greigg

[57] ABSTRACT

An injection pump for internal combustion engines having a pump piston bushing, a pump piston, guided in the bushing, including control edges for controlling the beginning and end of an injection event. The control edges cooperate with control bores provided in the wall of the pump piston bushing that discharge into a reservoir chamber surrounding the pump piston bushing; fuel can be delivered into this chamber under pressure, and excess fuel, or fuel overflowing at the end of an injection event, can be diverted from it. For the fuel delivery, a suction valve opening to the reservoir chamber is connected to the reservoir chamber, while for the fuel diversion, a check valve in the form of a pressure maintenance valve that opens away from the reservoir chamber is connected to the reservoir chamber. This pressure maintenance valve may be preceded on the inlet side by a throttle restriction.

6 Claims, 3 Drawing Sheets

FIG. 1
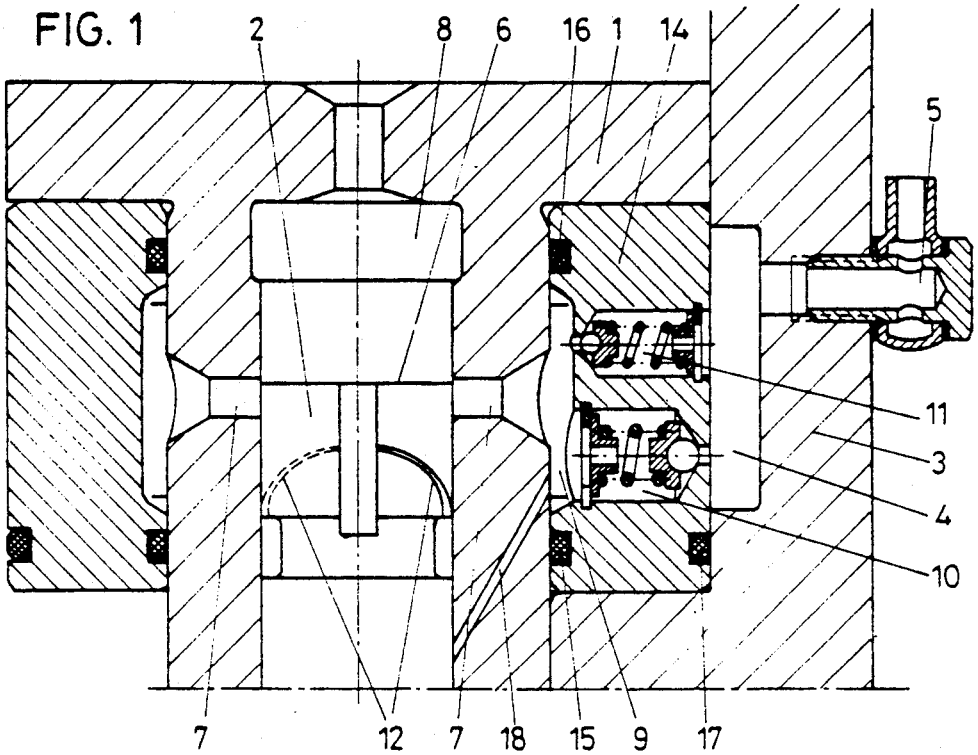
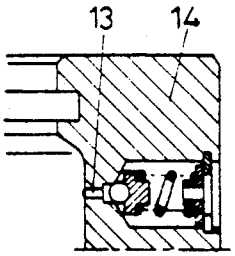
FIG. 2
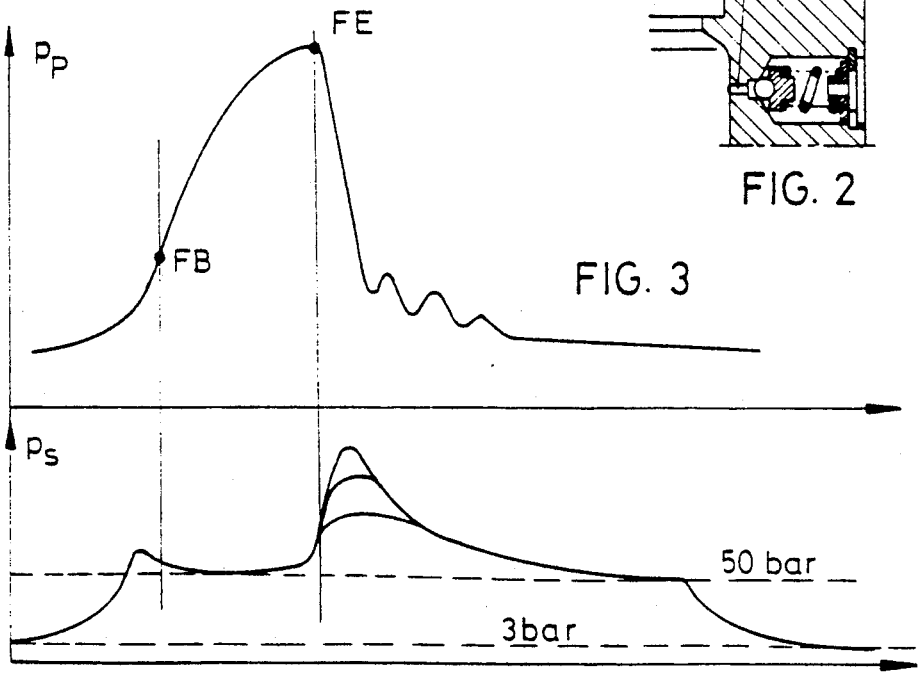
FIG. 3

INJECTION PUMP FOR INTERNAL COMBUSTION ENGINES

BACKGROUND OF THE INVENTION

The invention relates to an injection pump for internal combustion engines. The pump has a pump piston bushing and a pump piston, guided in the bushing, that has control edges for controlling the beginning and end of an injection event. The control edges cooperate with control bores provided in the wall of the pump piston bushing that discharge into a collecting chamber surrounding the pump piston bushing. Fuel can be delivered under pressure into the collecting chamber, and excess fuel, or fuel overflowing at the end of an injection event, can be diverted from the collecting chamber; for the fuel delivery, a suction valve opening to the collecting chamber is connected to the collecting chamber, while for the fuel diversion, a device that affects the flow is connected to the collecting chamber.

When injection pumps are operated at high pressure, corrosion problems due to cavitation phenomena arise upon the diversion to the low-pressure side. When the high-pressure fuel is diverted from the pump chamber to the suction chamber of the injection pump at the instant of the end of supply, pressure fluctuations with high peak values occur. Hollow spaces in the suction chamber resulting from the preceding supply event may implode and cause cavitation damage on the piston circumference, in the control bore and in the suction chamber. The diversion stream also creates secondary hollow spaces in its peripheral and impact zones, which in the ensuing implosion can also cause damage at the aforementioned sites. From Swiss Patent 594 134, it is already known to pump out the diverted fuel, which is returned to the suction chamber, via throttles, in order to attain a pressure increase to a certain extent. The extent of the pressure increase attainable with such provisions is relatively slight, and a decisive advantage cannot be attained unless a suitably high pump pre-pressure is selected. This, in turn, requires a great expenditure of pumping energy and necessitates a correspondingly costly sealing of the pump in the vicinity of the suction chamber.

OBJECT AND SUMMARY OF THE INVENTION

It is an object of the invention to attain the diversion of the injection pressure at the end of supply to the highest possible pressure, without expensive constructional provisions. To attain this object, the invention substantially comprises embodying the collecting chamber as a reservoir chamber having a pressure maintenance valve opening away from the reservoir chamber. Because the collecting chamber, or reservoir chamber, is no longer open toward the inflow, as in the known art, but instead is embodied as a reservoir chamber that is closed with valves, and a check valve is provided as the pressure maintenance valve, a predetermined, relatively high pressure can be assured as the diversion pressure. The pressure in the work chamber of the piston drops still further as a result, and only once the pressure overall has dropped to a level sufficient for the pump pre-pressure to be used for refilling of the work chamber does the re-filling take place at the substantially lower pump pre-pressure. The diversion is thus performed not directly into the suction chamber that is open to the inflow, but rather into the reservoir chamber, and by means of the check valve or pressure maintenance valve opening away from the reservoir chamber, this reservoir chamber can be kept at a pressure of up to 50 bar, or even higher, so the development of cavitation is effectively counteracted. In the suction operation of the pump piston, the fuel is first drawn from this reservoir chamber, and only after that is further fuel aspirated, for instance using a suction valve.

The embodiment is advantageously such that the reservoir chamber is connected, concentrically with a suction chamber, to the control bores of the pump piston bushing, which results in a particularly simple structure.

In a particularly simple manner, the embodiment may be such that the pressure maintenance valve opening away from the reservoir chamber and the suction valve opening toward the reservoir chamber are connected in common, on the side remote from the reservoir chamber, to the suction chamber that has been supplied with fuel, and are embodied by check valves. Because of the suction valve opening toward the reservoir chamber and embodied as a check valve, a renewed aspiration of fuel occurs whenever the pressure in the pump chamber drops below the set value of the suction valve. In this case, fuel for filling the injection pump is aspirated from the low-pressure suction chamber, that is, the chamber that is at pre-pump pressure.

To avoid undesirable pressure peaks in the buildup of pressure in the reservoir chamber, the embodiment may advantageously be such that the pressure maintenance valve opening away from the reservoir chamber is connected to the reservoir chamber via a throttle restriction known per se. The pressure to be maintained in the reservoir chamber is defined by the check valve in this case and is kept at a precisely predetermined level; additional throttle bores of this kind make it possible to diminish brief pressure peaks. As compared with the use of throttles without a pressure maintenance valve, there is an advantage in each case that a pressure level remains constant, once the predetermined pressure level has been reached, and that the corresponding pressure level can be assured in a simple manner by suitably dimensioning or adjusting the pressure maintenance valve.

In a further preferred embodiment for reducing wear, the arrangement is such that the axes of the mouths toward the reservoir chamber of the check valves are offset with respect to the axes of the control bores. An offset disposition of the control bores of this kind makes it possible for areas particularly vulnerable to wear, in which cavitation could occur, to be scavenged rapidly by suitable orientation of the entering stream, so that any bubbles that nevertheless form will be floated away. Any corrosion that nevertheless occurs can be kept away from particularly vulnerable locations.

In known injection pump constructions, it is known to reduce the excessive wear in the diversion process by incorporating impact protection means in the outflow openings. Such impact protection rings are unsuitable for preventing cavitation; they serve merely to provide materials that are especially wear-resistant so as to supply an expendable wearing part at locations of particularly high wear and abrasion; if wear occurs the part can simply be replaced. Conventional impact protection rings in particular, however, are completely incapable of counteracting cavitation on the outer wall of the pump piston. If additionally the wear due solely to high flow speeds and not to cavitation is to be further diminished, and if an easily replaced part is to be provided at such locations, then the embodiment having the scope of the invention is particularly advantageous, in which an impact protection means is disposed at the mouth, toward the reservoir chamber, of at least one check valve that is axially aligned with a control bore. The embodiment is advantageously such that an impact plate that closes an axial bore of the check valve is disposed as an impact protection means in front of this bore, and a transverse bore having open ends and intersecting the axial bore of the check valve is provided on the back of the impact plate; this in turn assures that any bubbles that may form will be scavenged away. In a particularly simple manner, the impact plate is integrally embodied with the housing of the check valve, which substantially simplifies the installation of the check valve.

In an embodiment known per se of an impact protection element of this kind, the element has a frustoconical cross section that is rounded on the side toward the bore. Such embodiments of impact protection elements are distinguished by particularly high wear resistance, and in such an embodiment, the disposition of the check valve opening toward the reservoir chamber is advantageously such that the control bore has a segment that widens frustoconically toward the reservoir chamber, that the housing of the check valve opening toward the reservoir chamber has a conical end portion having a rounded point and protruding into the frustoconically enlarged segment, leaving an intervening space, and that the outlet conduit of the check valve discharges eccentrically in the vicinity of the conical jacket of the end portion. The resultant flow route in turn contributes to the cleaning by scavenging of particularly critical locations.

The invention will be better understood and further objects and advantages thereof will become more apparent from the ensuing detailed description of preferred embodiments taken in conjunction with the drawings.

BRIEF DESCRIPTION OF THE DRAWINGS

FIG. 1 is a fragmentary section through the upper part of an injection pump for large Diesel engines;

FIG. 2 shows a modification of a detail of the injection pump of FIG. 1;

FIG. 3 is a diagram showing the course of the pump chamber pressure and reservoir chamber pressure plotted over the camshaft angle.

DESCRIPTION OF THE PREFERRED EMBODIMENTS

Figure 4:
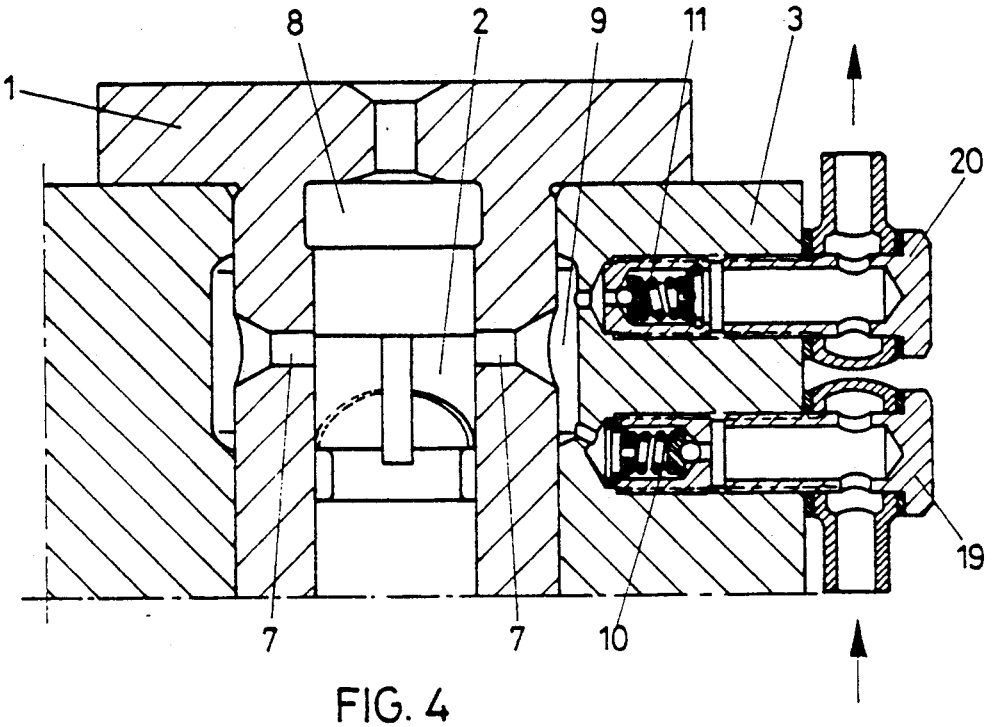
FIGS. 4, 5 and 6, in views similar to FIG. 1, show variants in the construction of an injection pump having direct introduction and diversion of fuel into and out of the reservoir chamber, as well as showing the embodiment of an impact protection means.

In the injection pump shown in FIG. 1, a pump piston 2 is moved up and down in a pump piston bushing 1 by a cam drive, not shown. The pump piston bushing 1 is supported in a housing 3 that has a suction chamber 4, into which fuel is delivered or from which excess fuel is diverted via a pipe union 5. In the upward stroke of the pump piston 2, the piston, with its upper edge 6, closes control bores 7. Even shortly before that, because of the piston 2 traveling upwardly and the throttling of the fuel positively displaced out of a pump chamber 8 formed by the bushing and the upper end of the piston, a fuel pressure builds up in the reservoir chamber 9 formed between the bushing and a sleeve 14. The pressure builds up in reservoir 9 because of the suction valve 10, having an opening pressure of a few tenths of a bar, has closed in the direction toward the suction chamber 4, and a pressure maintenance valve 11 maintains a pressure of approximately 20 to 50 bar in the reservoir chamber: Because of the pressure built up in the reservoir chamber 9, voids or vapor bubbles in the fuel that can arise there and in the control bores 7 during the delivery process collapse relatively gently and hence harmlessly. Once the pump piston 2, in its upward course, re-opens the connection between the pump chamber 8 and the control bores 7 with its lower control edges 12, the fuel relaxes from a high pressure of approximately 1500 bar to the pressure of approximately 20 to 50 bar maintained by the pressure maintenance valve 11 in the reservoir chamber 9. Because of the large margin of safety with respect to the vapor pressure of the fuel, voids do not form in the fuel in the vicinity of the diversion streams, so that the phenomenon known as fluid cavitation in the zone of impact of the diversion stream on the wall of the control bores and of the reservoir chamber is avoided. As soon as the pressure in the reservoir chamber 9 exceeds the set value of the pressure maintenance valve 11, this valve 11 opens and allows the excess fuel to drain out of the reservoir chamber 9 into the suction chamber 4. Both valves 10, 11 are embodied as one-way check valves.

A throttle 13 can be incorporated into the inlet of the pressure maintenance valve 11, as shown in FIG. 2, effecting a quantity-dependent increase in the reservoir chamber pressure, so that for larger supply quantities and/or higher rpm or piston speeds, the danger of voids forming in the fuel is reduced further. The suction valve 10 and the pressure maintenance valve 11 are accommodated in sleeve 14 that also contains the reservoir chamber 9. Pressure sealing of the reservoir chamber 9 and suction chamber 4 is effected by means of sealing rings 15, 16 and 17. Via an oil leakage line 18, fuel that flows downward in between the pump piston 2 and the pump piston bushing 1 is returned to the reservoir chamber 9.

It is useful not to dispose the two valves 10, 11, or their flow openings, in the same sectional plane as the control bores 7 in the pump cylinder, but instead to disposed them rotated by 90°, for example. Two or more pressure maintenance or suction valves can also be disposed as needed in the sleeve 14.

Finally, it is possible to harden the impact zones of the diversion streams in the reservoir chamber 9, or to armor them with particularly hard metals, to lend these areas particularly great stability.

FIG. 3 shows the courses of the pump chamber pressure $p_P$ and reservoir chamber pressure $p_S$ over the cam angle; the onset of supply by the injection pump is indicated at FB and the end of supply at FE. The diagram shows that at supply onset, the pressure $p_S$ in the reservoir chamber 9 already attains the maintenance value of the valve 11, and that directly after the end of supply, a brief dynamic additional pressure rise takes place in the reservoir chamber 9 because of the diverted fuel shooting out of the control bores 7; after that, when the pump chamber 8 is being filled, the pressure first drops to the supply pressure of the pre-pump, and then rises again after the beginning of the upward course of the pump piston 2. By means of a throttle bore preceding the pressure maintenance valve, a dependency of the reservoir chamber pressure on the supply quantity and on the pump rpm can be attained; various diameters of the throttle 13 produce different pressure courses in the vicinity of the additional pressure rise, as indicated in FIG. 3.

Figure 5:
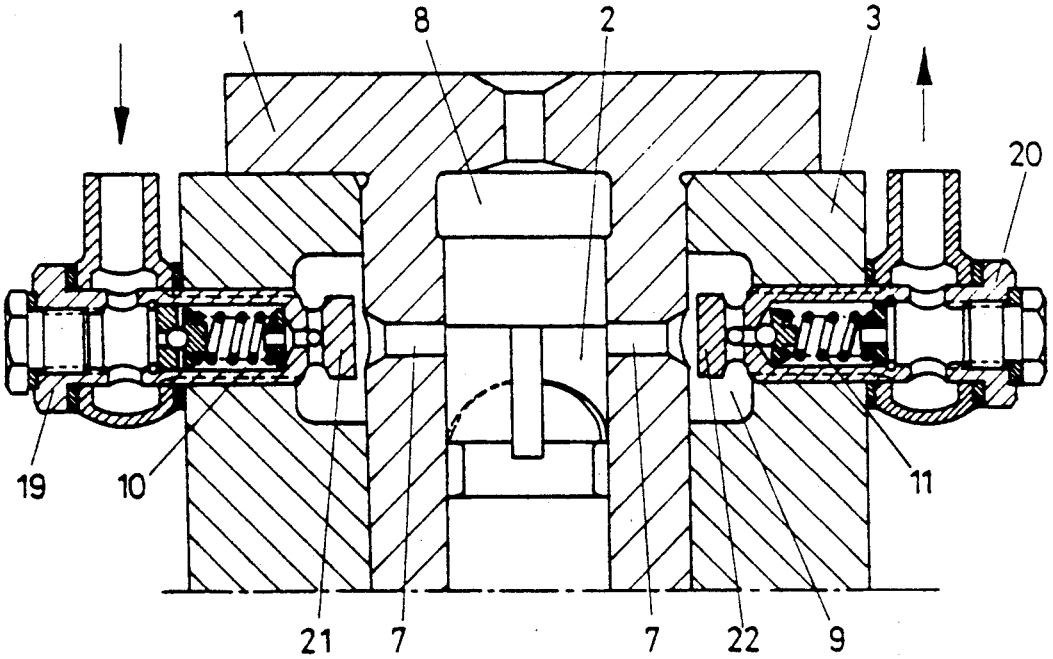

In the variants shown in FIGS. 4 and 5, a separate suction chamber is not provided; instead, the incoming fuel delivery 19 and diversion 20 of the fuel take place directly into or out of the reservoir chamber 9, that is, via the suction valve 10 or pressure maintenance valve 11, so that a higher pressure level—determined by the set pressure of the pressure maintenance valve 11—can build up in the reservoir chamber 9 during the delivery process immediately prior to the geometric supply onset. Upon diversion of fuel in the control bores 7, the high-pressure stream enters a fuel volume that has no remaining void spaces from the prior delivery. Stream cavitation is likewise avoided, because of the high pressure level.

It appears suitable to incorporate a pressure reservoir (air vessel) having a volume approximately 5 to 20 times that of the reservoir chamber into the fuel line from the feed pump which is connected to inlet 19. This provides for reliable filling of the reservoir chamber and pump chamber.

The axes of the bores toward the reservoir chamber leading to the valves 10 and 11 are offset with respect to the control bores 7, so that any voids formed in the fuel can be quickly scavenged away by the stream emerging from the control bore 7, and any corrosion that might occur is kept away from vulnerable areas.

In the embodiment of FIG. 5, the inlet delivery 19 and diversion 20 of the fuel are coaxial with the control bores 7, but the bore of each of the valves 10, 11 that is oriented toward the control bore 7 is preceded by an impact plate 21 or 22, serving as an impact protector, and each impact plate is integrally embodied with the fitting of the associated valve.

Figure 6:
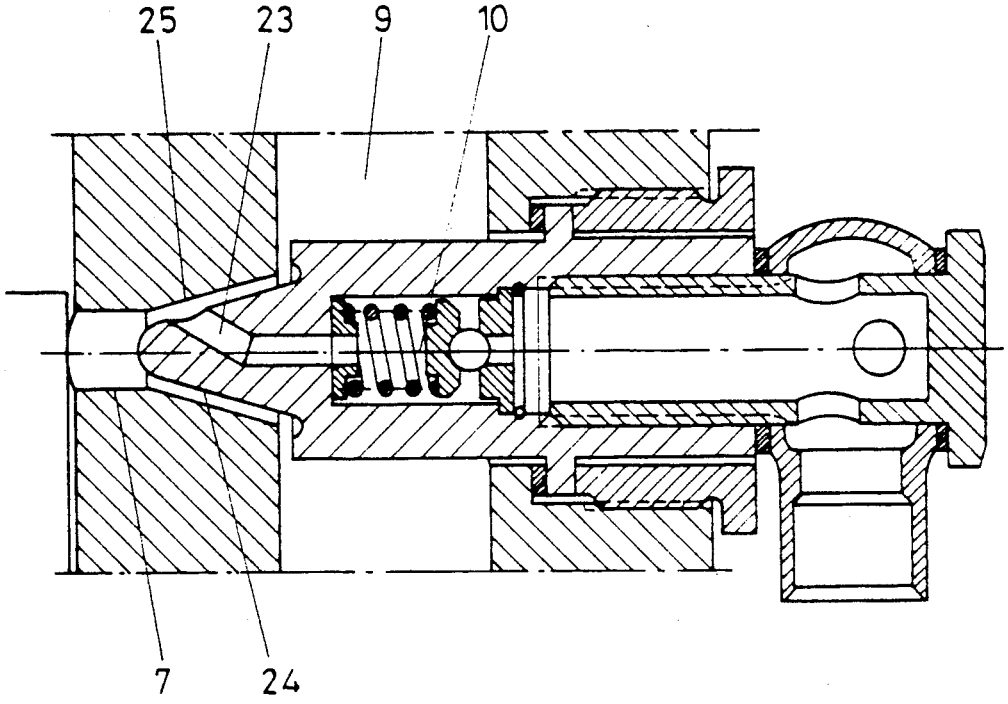

In a further variant shown by FIG. 6, the suction valve 10, only one valve being shown, is incorporated on both sides into an impact protector, which has a conical shape and which protrudes far into the control bore 7. The fuel, arriving from the suction valve 10 through a bore 23, is pumped into the gap between the cone 24 of the impact protector and the conical enlargement 25 of the control bore. The bore 23 is positioned such that it causes the fuel to emerge at the highest part of the gap, so that voids in the fuel located there are impacted upon directly by the scavenging stream and pumped into the reservoir chamber. A pressure maintenance valve, not shown, provides for the maintenance of an elevated static pressure in the reservoir chamber 9 from after the end of the delivery process until re-aspiration. The supply of fuel is suitably effected at a pressure of from 5 to 20 bar, in order to attain an adequate scavenging action in the control bores 7. Once again, it seems useful to dispose a pressure reservoir in the fuel line between the feed pump and the suction valve 10, to even out the inflow pressure.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. An injection pump for internal combustion engines, having a housing, a pump piston bushing in said housing, a pump piston guided in said bushing, said pump piston having control edges for controlling the beginning and end of an injection event, the control edges cooperating with control bores provided in the wall of said pump piston bushing that permit fuel flow from and into a collecting chamber surrounding the pump piston bushing, into which collecting chamber fuel is delivered under pressure, and from which collecting chamber excess fuel, or fuel overflowing at the end of an injection event, is diverted, a suction valve (10) that opens toward the collecting chamber is connected to the collecting chamber for the delivery of fuel, while for the fuel diversion, said collecting chamber is embodied as a reservoir chamber (9) having pressure maintenance valve (11) which opens in a direction away from the reservoir chamber (9), said control bores (7) of the pump piston bushing (1) are connected to said reservoir chamber (9) and said reservoir chamber (9) is concentric with a suction chamber (4) which is connected to said reservoir chamber via said suction valve (10).

2. An injection pump as defined by claim 1, in which said pressure maintenance valve (11) that opens away from the reservoir chamber (9) and the suction valve (10) that opens toward the reservoir chamber (9) are connected in common to the suction chamber (4) that is supplied with fuel on the side remote from the reservoir chamber (9) and are embodied as check valves.

3. An injection pump as defined by claim 1, in which said pressure maintenance valve (11) opens away from the reservoir chamber (9) and is connected to the reservoir chamber (9) via a throttle restriction (13).

4. An injection pump as defined by claim 3, in which said pressure maintenance valve (11) opens away from the reservoir chamber (9) and is connected to the reservoir chamber (9) via a throttle restriction (13).

5. An injection pump as defined by claim 1, in which the axes of said suction valve (10) and said pressure maintenance valve (11) are offset with respect to the axes of the control bores (7).

6. An injection pump as defined by claim 2, in which the axes of said check valves (10,11) are offset with respect to the axes of the control bores (7).

* * * * *